United States Patent [19]

Orea Mateo

[11] 4,198,770

[45] Apr. 22, 1980

[54] DEVICE FOR FIXING HEELS

[76] Inventor: Fernando Orea Mateo, Edificio Torres Blancas-Avda. de America, 37,945, Madrid, Spain

[21] Appl. No.: 917,647

[22] Filed: Jun. 21, 1978

[30] Foreign Application Priority Data

Feb. 9, 1978 [ES] Spain ..... 233.843[U]
Feb. 9, 1978 [ES] Spain ..... 233.844[U]

[51] Int. Cl.[2] ..... A43B 21/36
[52] U.S. Cl. ..... 36/42; 36/36 A
[58] Field of Search ..... 36/42, 41, 36

[56] References Cited

U.S. PATENT DOCUMENTS 2,139,885 12/1938 De Gironimo ..... 36/36 R

FOREIGN PATENT DOCUMENTS 513172 11/1930 Fed. Rep. of Germany ..... 36/42
1230927 4/1960 France ..... 36/42
543725 5/1956 Italy ..... 36/42

*Primary Examiner*—James Kee Chi
*Attorney, Agent, or Firm*—Wenderoth, Lind & Ponack

[57] ABSTRACT

A heel is longitudinally traversed by a threaded stem provided with a head which can be activated from the lower zone of the heel and whose free end is screwed into a blind hole made centrally in a projection of the lower face of a flat cover which is adjusted in a recess made in the upper zone of the heel. The flat cover is solidly fastened to a plate arranged on the upper face of the inner sole by fixing elements which pass through the inner sole and its inner shank.

5 Claims, 4 Drawing Figures

DEVICE FOR FIXING HEELS

The present invention refers to a device for fixing heels, and more particularly to a device for fixing women's heels to the inner sole of mass-produced shoes.

Generally, the present invention comprises a heel in the interior of which is housed a series of pieces which, together with another outer piece arranged on the inner sole of the shoe, permit joining of the heel and the inner sole and, consequently, of the heel and the remainder of the shoe. In this way, the conventional joining methods, such as sewing or pasting, are eliminated since the structure of the shoe caused a high percentage of breakages during joining and, consequently, the shoe became useless.

Specifically, the invention consists in arranging in the heel a flat upper piece which can be adjusted and regulated in the heel by a threaded stem activated from the lower zone of the heel, which flat piece is joined to a metal plate arranged on the inner sole of the shoe by nuts and threaded stems which pass through the mentioned inner sole and, consequently, the inner shank thereof.

With this structure a rapid joining of the heel to the rest of the shoe is obtained, which joining is furthermore susceptible of being tightened in the determined measure by the threaded stem which can be activated from the lower zone of the heel. The rigid fixing obtained with this device will prevent the consequent breakages which the shoes have heretofore undergone, the joining of which was effected by sewing and pasting, which breakages were frequent and besides rendered the shoe useless since it was very difficult or impossible to repair.

To complement the description which will subsequently be made and for a better understanding of the characteristics of the invention, a set of drawings is attached to this specification wherein the following is represented.

Figure 1:
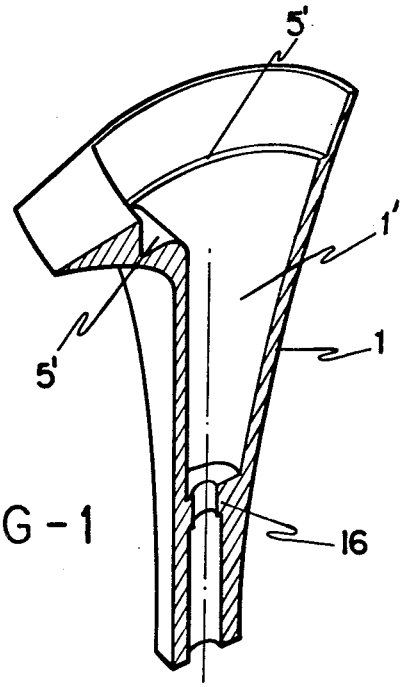

FIG. 1 illustrates a perspective view of the cut heel provided with an upper stepped recess and a lower transversal wall with an axial orifice.

Figure 2:
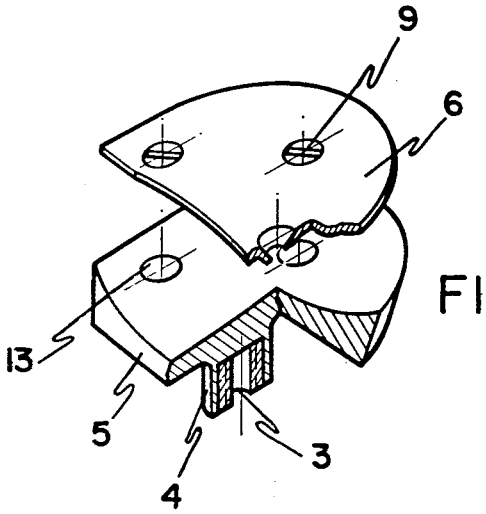

FIG. 2 corresponds to a perspective view with a cut portion of the piece constituting the flat cover and of the upper plate which is arranged on the upper zone of the inner sole.

Figure 3:
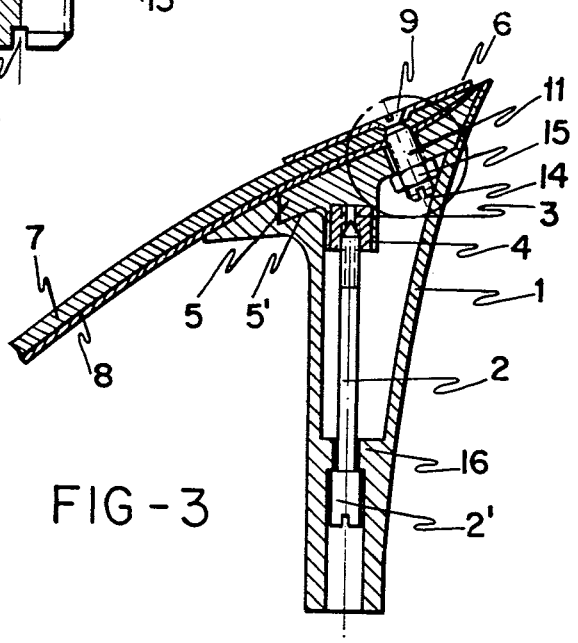

FIG. 3 corresponds to a cut view of the assembly of the shoe illustrating the joining between the heel and the inner sole with the elements and means claimed in this invention.

Figure 4:
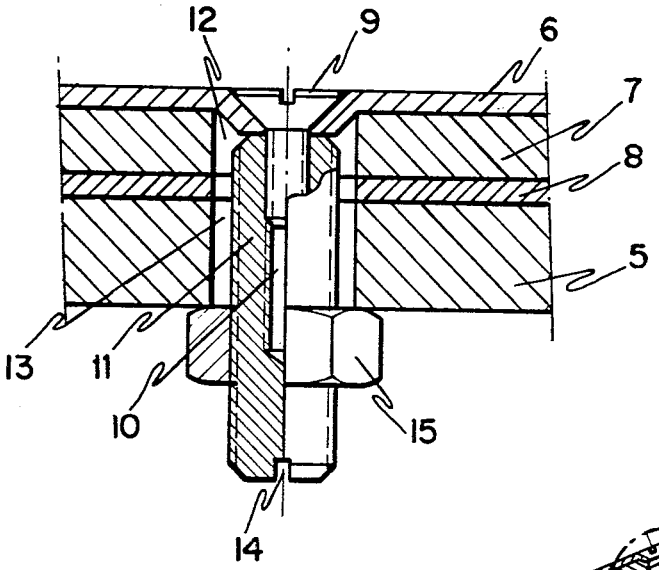

Finally, FIG. 4 corresponds to an enlarged cut view of FIG. 3 wherein the means for joining the flat cover and the upper piece arranged on the inner sole can be seen.

These figures illustrate the heel 1 which is longitudinally cut by a threaded stem 2 provided with a head 2' which can be activated from the lower zone of the mentioned heel 1. FIG. 1 of the attached drawings represents a hollow heel wherein, therefore, there already exists a suitable passage for the mentioned threaded stem. Nevertheless, the heel can also be solid in which case an axial passage for the mentioned threaded stem 2 should be provided for therein.

The free end of the threaded stem 2 is screwed into a blind hole 3 arranged in the centre of a projection 4 of the lower face of the flat cover 5.

The flat cover 5 is adjusted in a recess 5' made in the upper zone of the heel 1.

The flat cover 5 is solidly fastened to a plate 6 placed on the upper surface of the inner sole 7 and which has its corresponding inner shank 8.

The plate 6 has at least three screws 9 solidly fastened to its lower face, which screws 9 are screwed into blind orifices 10 arranged at the ends of threaded stems 11 and which are placed in the orifices 12 and 13 coinciding with the inner sole 7 and with the flat cover 5. The stems 11 have, at the end opposite to their blind hole 10, a diametral notch 14 for manipulation thereof. On this threaded stem 11 there is placed a nut 15 which will permit fixing between the flat cover 5 and the plate 6, between which the inner sole 7 with its corresponding shank 8 will be retained.

On the basis of this constitution, the assembly of the heel 1 on the inner sole 7 is as follows:

The plate 6 is arranged on the upper zone of the inner sole 7 so that the screws 9 thereof coincide with the orifices 12 in the mentioned inner sole. In this position, the stems 11 are placed on the mentioned screws 9 and once the three stems 11 are situated, the flat cover 5 will be made to coincide with the mentioned stems 11 through the orifices 13 thereof. In this position, the nuts 15 are adjusted, whereby the assembly is completely joined.

Thereafter, the assembly is so placed that the flat cover 5 is situated perfectly on the recess 5'. In this position, the stem 2 is introduced through the lower zone of the heel, and by acting on its head 2' joining between the free end of the stem 2 and the previously mentioned assembly is obtained, on being screwed into the blind hole 3 of the projection 4 of the flat cover 5. This joining, by a greater or lesser screwing of the stem 2 in the blind hole 3, permits the tension of the fixing between the heel 1 and the inner sole 7 to be regulated.

As can be seen in FIG. 3 of the attached drawings, when the heel 1 is hollow same has a lower transversal partition 16 provided with an axial passage which serves as a guide for the stem 2 and a penetration butt for the head 2' thereof.

I claim:

1. An adjustable heel assembly for attachment to a shoe inner sole having an inner shank, said heel assembly comprising:

a hollow heel having an upper portion with a recess therein and a lower portion having a transverse partition, said partition having therethrough an orifice;

a flat cover fitting within said recess, said flat cover having depending therefrom an integral projection having therein a blind hole, said flat cover adapted to fit beneath a shoe inner sole having an inner shank;

a plate adapted to fit over the shoe inner sole at a position above said flat cover;

joining means, adapted to extend through the inner sole and the inner shank thereof, for connecting said plate to said inner cover and for thereby retaining the inner sole and inner shank therebetween; and means for removably attaching said heel to said flat cover and for adjusting the tension of attachment therebetween, said attaching means solely comprising an elongated stem extending through said heel from said bottom portion thereof, said stem having a free upper end threaded into said blind hole of said projection of said flat cover, and said stem extending through said orifice of said partition and having a lower end with a head abutting said partition.

2. A heel assembly as claimed in claim 1, wherein said joining means comprises a plurality of threaded units extending through aligned holes in said plate, the inner sole and inner shank, and said flat cover.

3. A heel assembly as claimed in claim 2, comprising at least three said threaded units.

4. A heel assembly as claimed in claim 2, wherein each said threaded unit comprises a screw extending through and depending from said plate, an exteriorly threaded stem extending through the inner sole and inner shank and said flat plate, said stem having an upper end with an interiorly threaded blind hole, said screw being threaded into said blind hole, and a nut threaded onto the exterior threads of a lower end of said stem, said nut abutting a lower face of said flat cover.

5. A heel assembly as claimed in claim 4, wherein said lower end of said stem and said nut extend into the hollow, open interior of said hollow heel.

* * * * *